US007988070B1

(12) United States Patent
Yang et al.

(10) Patent No.: US 7,988,070 B1
(45) Date of Patent: Aug. 2, 2011

(54) SHOWER HEAD WITH BRUSH UNIT

(76) Inventors: Chih-Sheng Yang, Tainan County (TW); Chiao-Cheng Yang, Tainan County (TW); Tsung-Te Liu, Tainan County (TW); Han-Hua Liu, Tainan County (TW)

( * ) Notice: Subject to any disclaimer, the term of this patent is extended or adjusted under 35 U.S.C. 154(b) by 0 days.

(21) Appl. No.: 12/659,924

(22) Filed: Mar. 25, 2010

(51) Int. Cl.
*B05B 15/02* (2006.01)

(52) U.S. Cl. ..... 239/116; 239/106; 239/114; 239/548; 15/24; 15/29

(58) Field of Classification Search ..... 239/106, 239/114, 115, 123, DIG. 13, 600, 548; 220/234; 15/24, 29
See application file for complete search history.

(56) References Cited

U.S. PATENT DOCUMENTS

| | | | | | |
|---|---|---|---|---|---|
| 4,151,623 | A * | 5/1979 | Steere | 15/21.1 |
| 4,209,132 | A * | 6/1980 | Kwan | 239/381 |
| 4,703,893 | A * | 11/1987 | Gruber | 239/391 |
| 5,060,990 | A * | 10/1991 | Smith et al. | 292/91 |
| 5,129,121 | A * | 7/1992 | Gelman | 15/29 |
| 5,433,384 | A * | 7/1995 | Chan et al. | 239/449 |
| 6,659,372 | B2 * | 12/2003 | Marsh et al. | 239/560 |
| 2008/0111004 | A1 * | 5/2008 | Huffman | 239/114 |

* cited by examiner

*Primary Examiner* — Dinh Nguyen
*Assistant Examiner* — Viet Le
(74) *Attorney, Agent, or Firm* — Alan Kamrath; Kamrath & Associates PA

(57) ABSTRACT

A shower head includes a case having a chamber with an opening, and a cover is slidably engaged with the opening and has multiple holes. The cover has an inner space defined therein, and a brush unit is rotatably located in the inner space and the chamber. The brush unit includes multiple blades, and each blade has brushes connected thereto. The brush unit rotates by the water flow so as to brush the inner surface of the chamber.

6 Claims, 7 Drawing Sheets

SHOWER HEAD WITH BRUSH UNIT

BACKGROUND OF THE INVENTION (1) Field of the Invention

The present invention relates to a shower head and more particularly, to a shower head with a brush unit rotatably located therein to brush the inside of the shower head during use.

(2) Description of the Prior Art

A conventional shower head generally includes an elongate handle and a substantially round head which is connected to a first end of the head. The head includes a pattern plate which has multiple holes, and a hose is connected to a second end of the head so as to introduce water into the head via the hose. The user holds the handle and the water flows through the holes so as to take a shower. The water is pressurized by the water pressure and can be delivered to a higher position. Thus, an alternative way to use the shower head is to position the shower head on a support member on the wall at a height so that the user does not need to hold the shower head.

However, there is no proper cleaning device equipped in the shower head, so that the shower head basically is not cleaned, and accumulation can be stocked within the shower head. The accumulation may have a variety of germs involved and may have sanitary problems.

The present invention provides a shower head which improves the shortcomings of the conventional shower head.

SUMMARY OF THE INVENTION

The present invention relates to a shower head and comprises a case having a chamber with an opening. A brush unit is rotatably connected to the case and located in the chamber. The brush unit has multiple blades, and each blade has brushes connected thereto. A cover is slidably engaged with the opening and has multiple holes. The cover has an inner space defined therein, and a sanitary unit is engaged with the inner space and has multiple apertures.

The primary object of the present invention is to provide a shower head having a brush unit received therein and which is rotated by the water flow so as to remove the accumulation during use to reduce the accumulation on the inside of the shower head.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENTS

Figure 1:
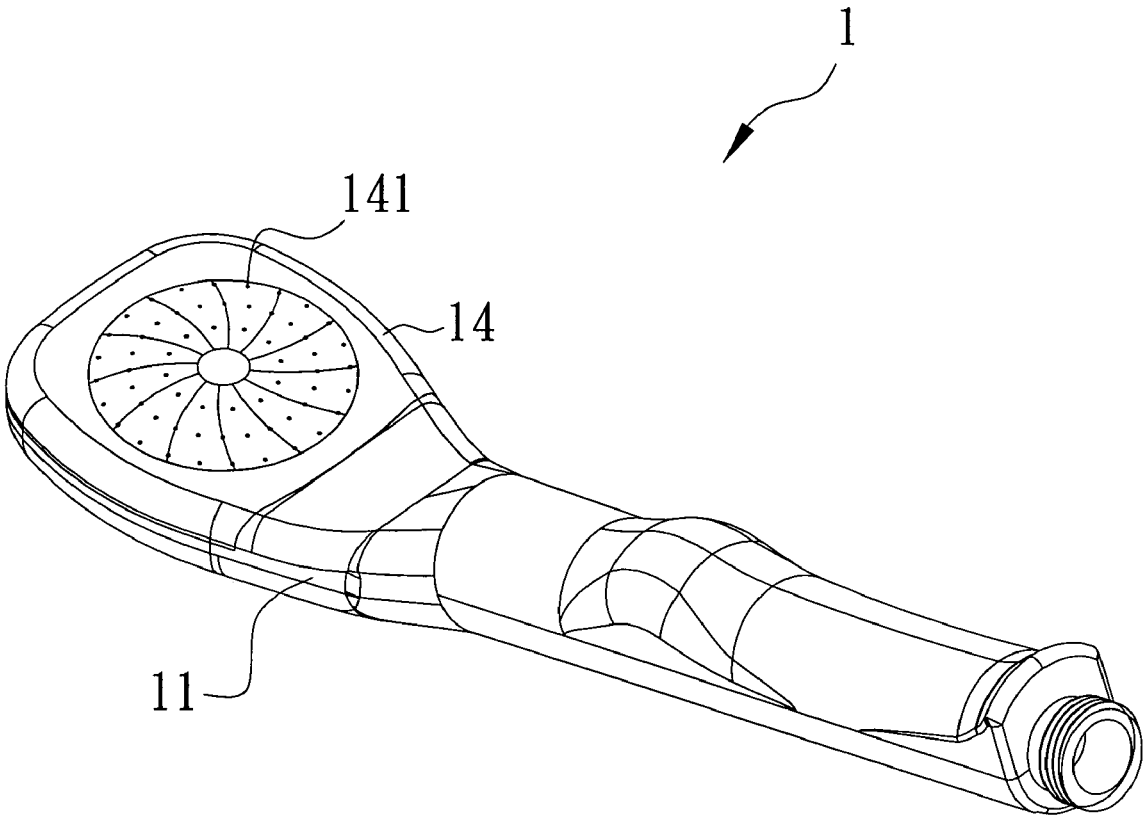
FIG. 1 is a perspective view showing the shower head of the present invention.
Figure 2:
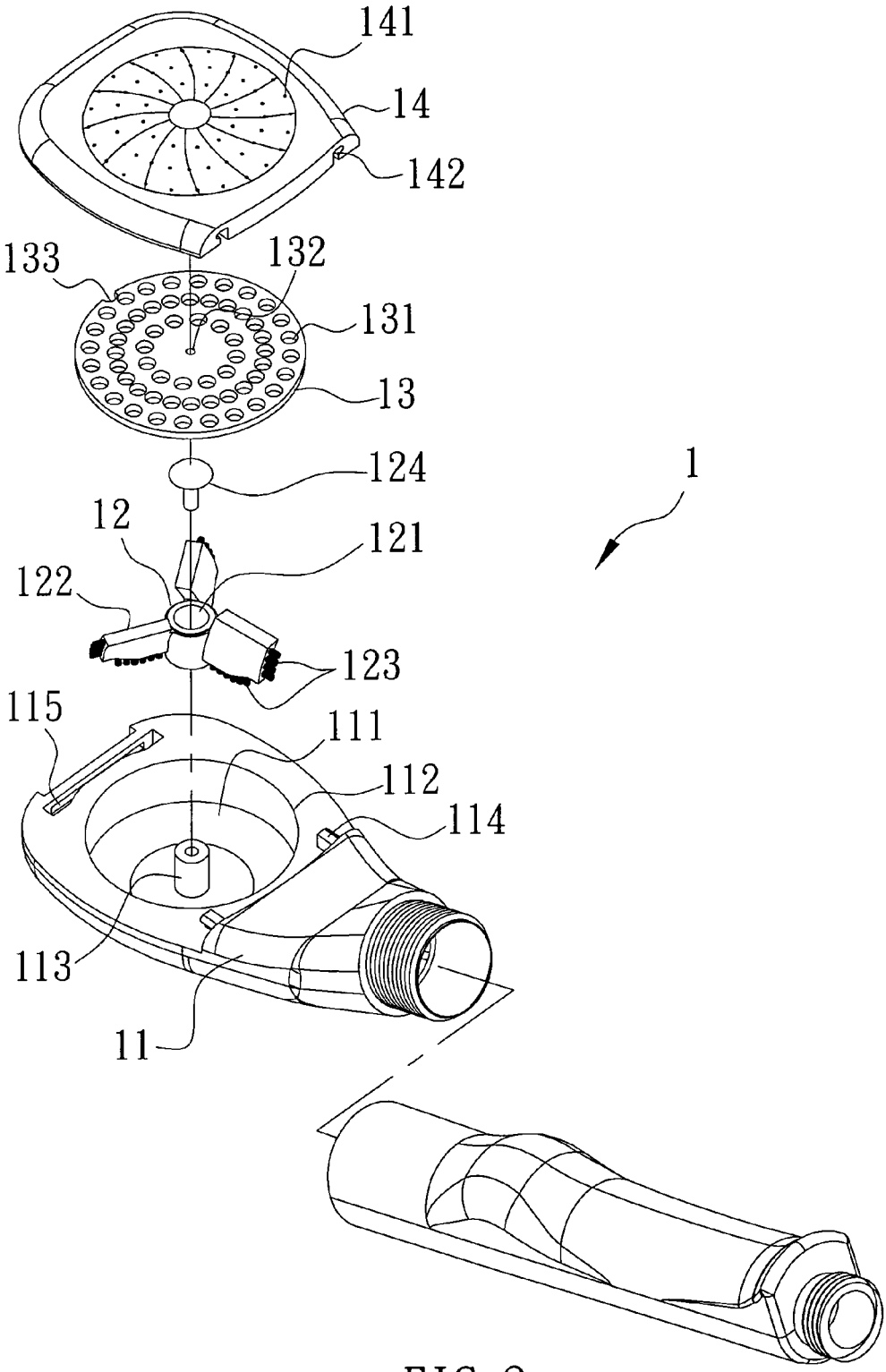
FIG. 2 is an exploded view showing the shower head of the present invention.

Referring to FIGS. 1 to 5, the shower head 1 of the present invention comprises a case 11 having a chamber 111 with an opening 112 defined in an underside thereof. A tube 113 extends from an inner end of the chamber 111. A slot 115 is defined in the underside of the case 11, and two protrusions 114 are located on the underside of the case 11. The opening 112 is located between the slot 115 and the protrusions 114. A brush unit 12 is rotatably connected to the case 11 and located in the chamber 111. The brush unit 12 has a central hole 121 and multiple blades 122. Each blade 122 has brushes 123 connected thereto. The tube 113 extends through the central hole 121 to pivotably connect the brush unit 12 in the chamber 111, and a pin 124 extends through the central hole 121 and is engaged with the tube 113 to position the brush unit 12.

A cover 14 is slidably engaged with the opening 112 and has multiple holes 141. The cover 14 has an inner space 145 defined in a top surface thereof, and two blocks 143 are located on the top surface of the cover 14. Two grooves 142 are defined in the top surface of the cover 14. The inner space 145 is located between the blocks 143 and the grooves 142. The cover 14 is slidably connected to the underside of the case 11 by engaging the protrusions 114 with the grooves 142, and the blocks 143 are engaged with the slot 115. The inner space 145 communicates with the opening 112.

A sanitary unit 13 is engaged with the inner space 145 and has multiple apertures 131. The sanitary unit 13 includes a central hole 132 and a notch 133. A positioning stub 144 extends radially from a periphery of the inner space 145, and an axle 146 is located at a center of the inner space 145. The axle 146 extends through the central hole 132, and the positioning stub 144 is engaged with the notch 133.

Figure 3:
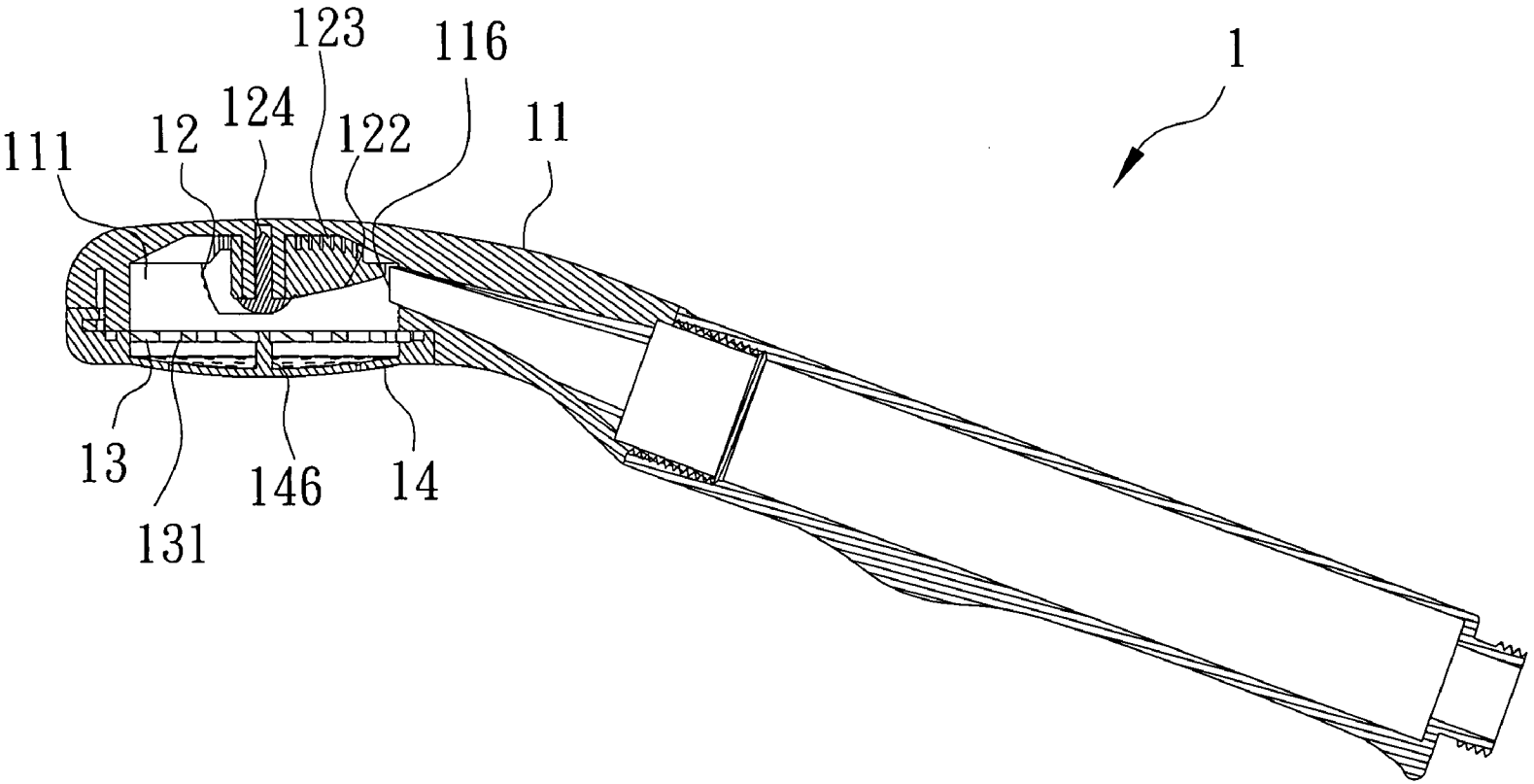
FIG. 3 is a cross sectional view showing the shower head of the present invention.
Figure 4:
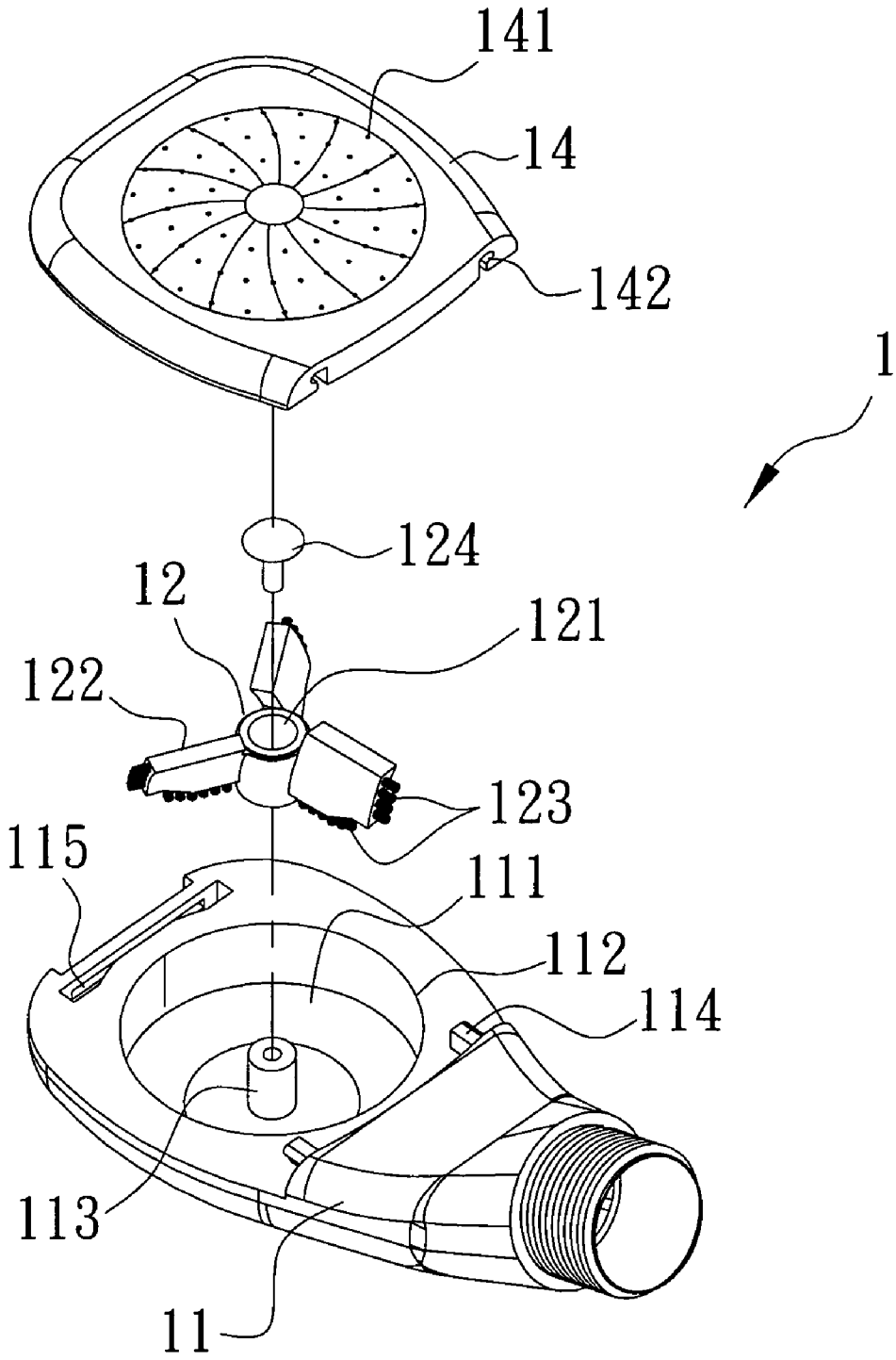
FIG. 4 shows the case, the brush unit and the cover of shower head of the present invention.
Figure 5:
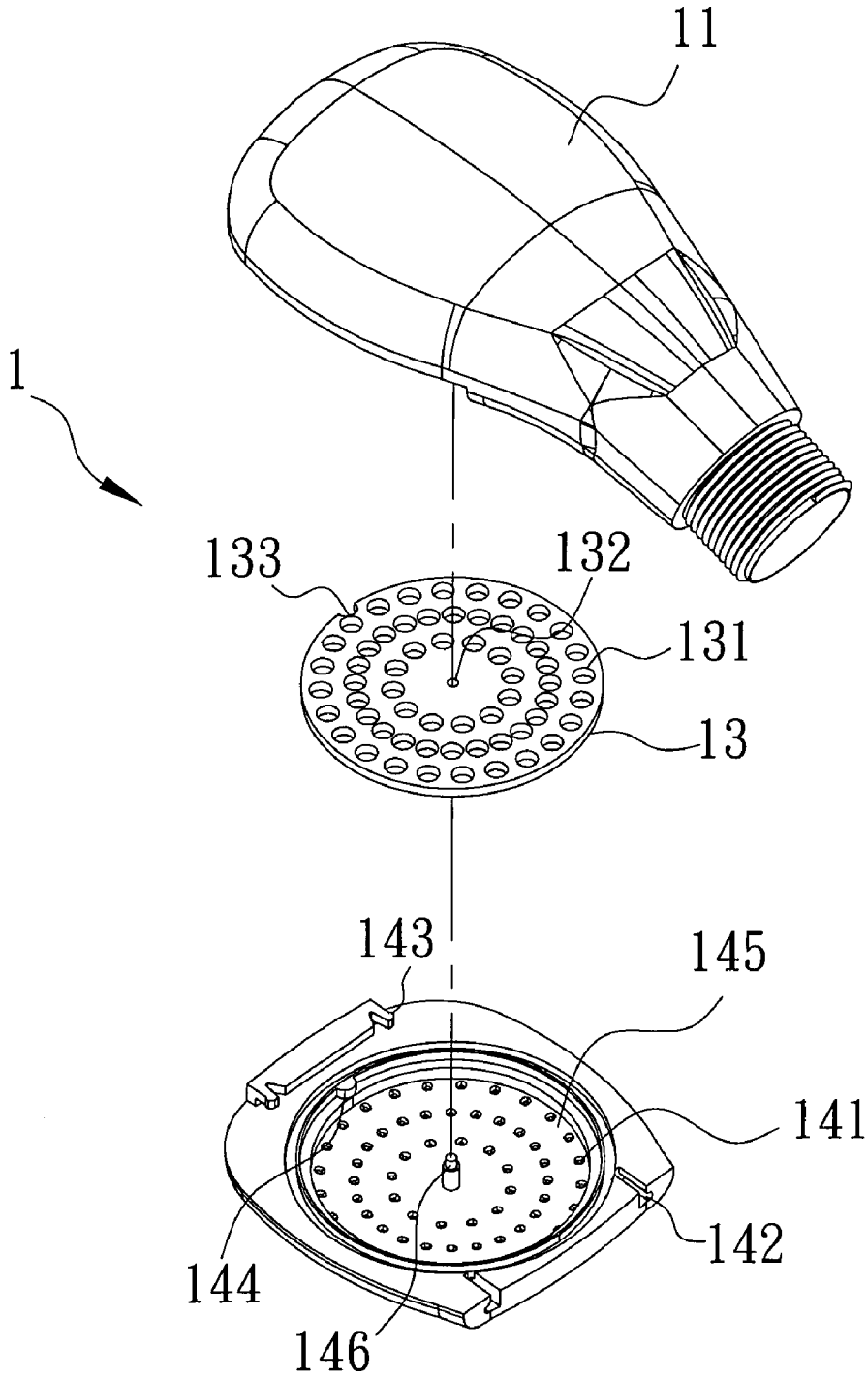
FIG. 5 shows the sanitary unit located between the case and the cover.
Figure 6:
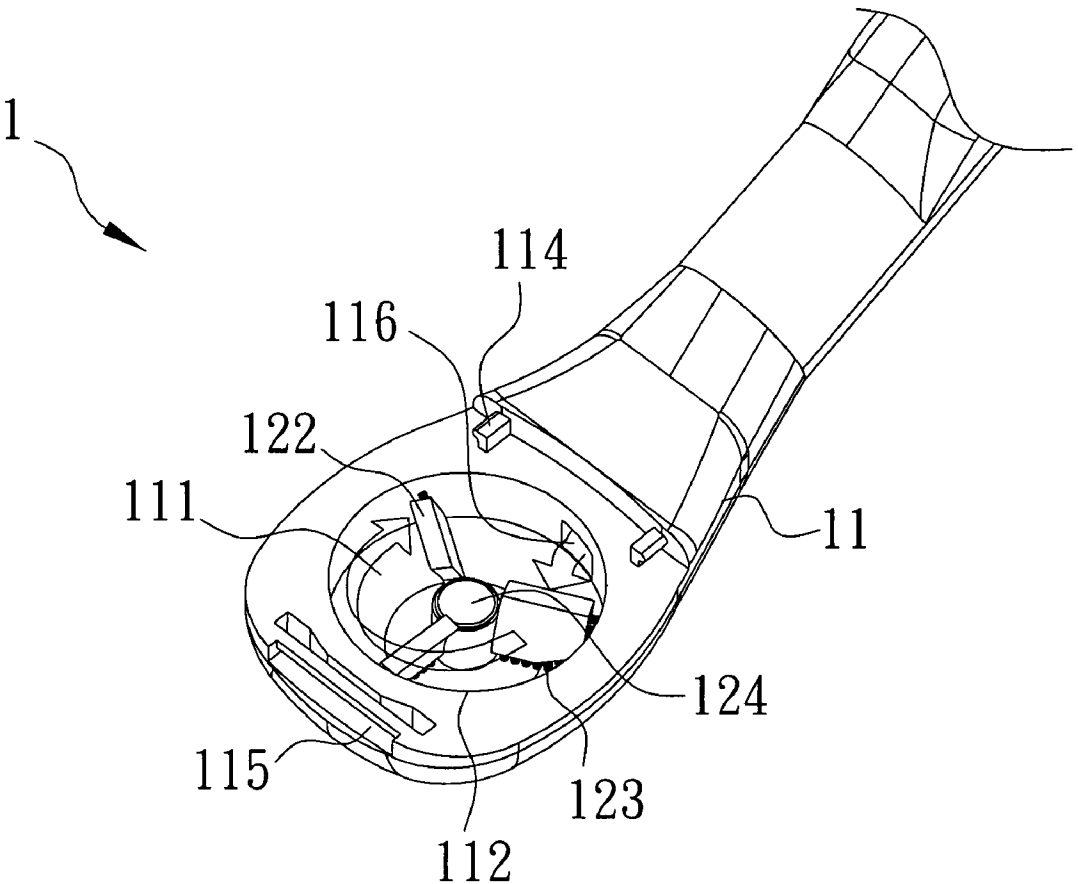
FIG. 6 shows that the brush unit rotates by the water flow.
Figure 7:
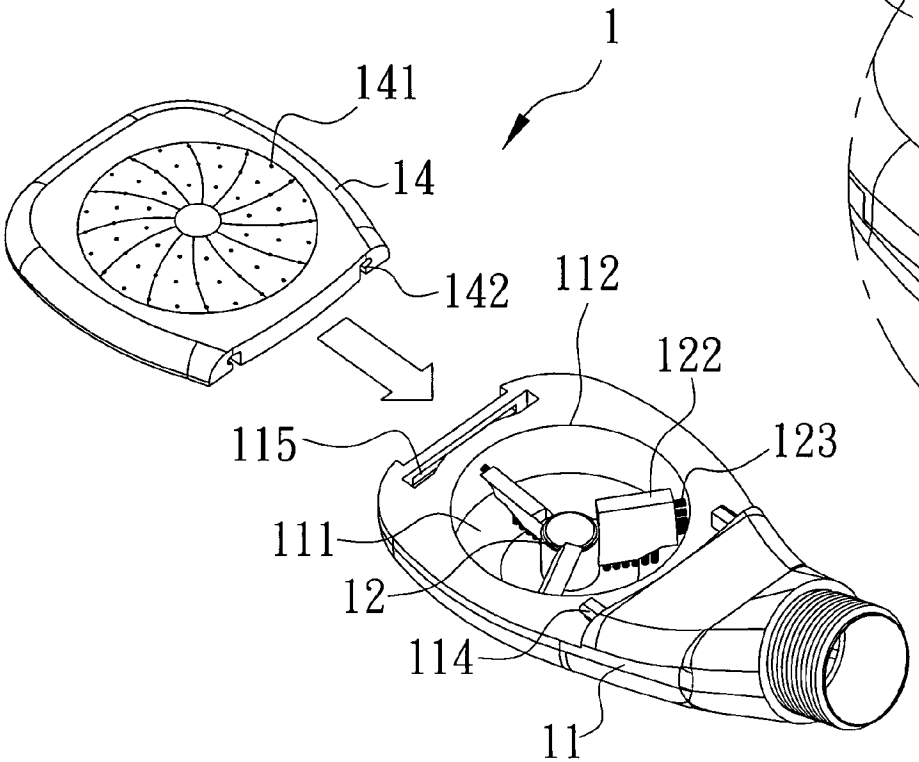
FIG. 7 shows that the cover is slidably connected to the case.

Referring to FIGS. 6 and 7, the case 11 is connected to a handle, and a passage 116 as shown in FIG. 3 is defined through the case 11. A hose (not shown) is connected to the handle and introduces water into the passage 116. The brush unit 12 is rotated by the water flow, and the brushes 123 brush the inner surface of the chamber 111.

Figure 8:
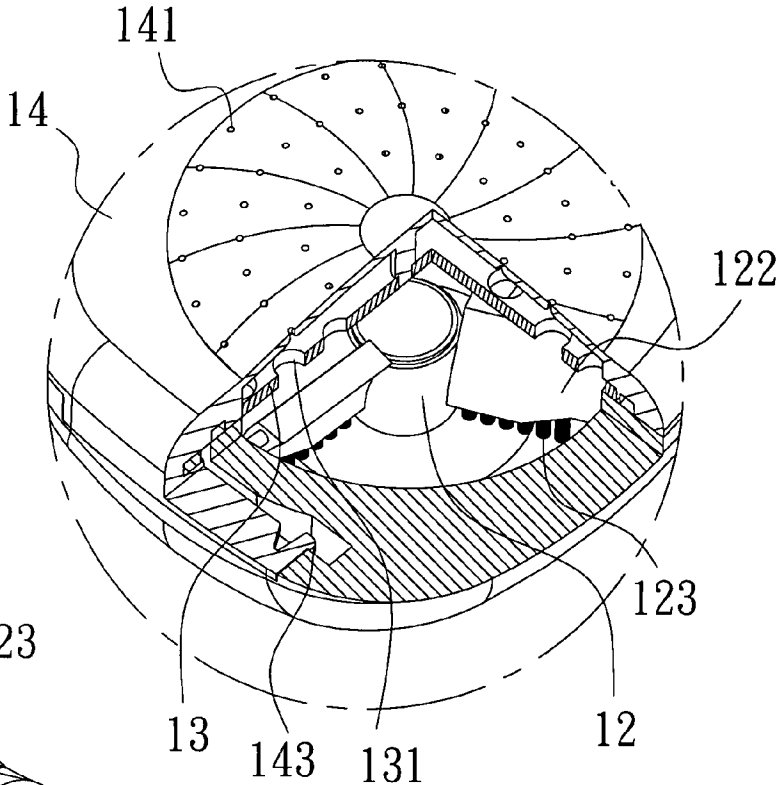
FIG. 8 is a partial cross sectional view showing the shower head of the present invention.

As shown in FIGS. 7 and 8, the cover 14 is easily disengaged from the case 11 by pressing the blocks 143 and then sliding the cover 14 relative to the case 11 to disengage the cover 14 from the case 11. The sanitary unit 13 can be replaced.

While the embodiment in accordance with the present invention has been shown and described, it should be clear to those skilled in the art that further embodiments may be made without departing from the scope of the present invention.

What is claimed is:

1. A shower head comprising:

a case having a chamber with an end, a cylindrical periphery extending from the end, and an opening, with the case further including a tube extending from the end, with the cylindrical periphery being concentric to the tube;

a brush unit rotatably connected to the case and located in the chamber, with the brush unit having a central hole and multiple blades, with each blade having first and second brushes connected thereto, with the central hole rotatably receiving the tube, with the first brush engaging the end of the chamber around the tube, with the second brush engaging the cylindrical wall of the chamber;

a cover slidably engaged with the opening and having multiple holes, with the cover having an inner space defined therein; and a sanitary unit engaged with the inner space and having multiple apertures, with the sanitary unit located intermediate the cover and the brush unit, with the brush unit being spaced from the sanitary unit, with the tube extending from the end towards but spaced from the sanitary unit.

2. The shower head as claimed in claim 1, wherein a slot is defined in an underside of the case and two protrusions are located on the underside of the case, and wherein the opening is located between the slot and the protrusions.

3. The shower head as claimed in claim 2, wherein the cover has two blocks on a top surface thereof and two grooves are defined in the top surface of the cover, and wherein the inner space is located between the blocks and the grooves, with the two grooves slidably receiving the two protrusions with the two blocks received in the slot.

4. The shower head as claimed in claim 3, wherein the cover is slidably connected to the underside of the case, and wherein the inner space communicates with the opening.

5. The shower head as claimed in claim 1, wherein a positioning stub extends radially from a periphery of the inner space and an axle is located at a center of the inner space.

6. The shower head as claimed in claim 5, wherein the sanitary unit is located in the inner space of the cover and includes a central hole and a notch, the axle extends through the central hole and the positioning stub is engaged with the notch.

* * * * *